US005972195A

United States Patent [19]

Roberts et al.

[11] Patent Number: 5,972,195

[45] Date of Patent: Oct. 26, 1999

[54] METHOD OF ELECTROLYTICALLY PRODUCING EPOXIDES

[75] Inventors: David G. Roberts, Gibsonia; Peter C. Foller, Murrysville; Robert H. Tang, Murrysville; Yingchao Zhang, Murrysville, all of Pa.

[73] Assignee: PPG Industries Ohio, Inc., Cleveland, Ohio

[21] Appl. No.: 09/112,658

[22] Filed: Jul. 9, 1998

[51] Int. Cl.[6] ..... C25B 3/00

[52] U.S. Cl. ..... 205/428; 205/456

[58] Field of Search ..... 205/428, 456

[56] References Cited

U.S. PATENT DOCUMENTS

| | | | |
|---|---|---|---|
| 3,288,692 | 11/1966 | Le Duc | 204/80 |
| 3,351,635 | 11/1967 | Kollar | 260/348.5 |
| 3,427,235 | 2/1969 | Le Duc | 204/78 |
| 3,451,905 | 6/1969 | Krönig et al. | 204/80 |
| 3,501,388 | 3/1970 | Krönig et al. | 204/79 |
| 3,635,803 | 1/1972 | Binns et al. | 204/80 |
| 4,224,129 | 9/1980 | McIntyre et al. | 204/263 |
| 4,317,704 | 3/1982 | McIntyre et al. | 204/1 R |
| 4,481,303 | 11/1984 | McIntyre et al. | 502/159 |
| 4,560,451 | 12/1985 | Nielsen | 204/79 |
| 4,631,200 | 12/1986 | Bierschenk | 427/113 |
| 4,634,506 | 1/1987 | Novak et al. | 204/80 |
| 4,726,887 | 2/1988 | McIntyre | 204/80 |
| 5,527,436 | 6/1996 | Cooker et al. | 204/428 |

FOREIGN PATENT DOCUMENTS

| | | |
|---|---|---|
| 637691 | 3/1964 | Belgium . |
| 1258856 | 1/1968 | Germany . |
| 1090006 | 11/1967 | United Kingdom . |

OTHER PUBLICATIONS

Holbrook et al., "Electrooxidation of Olefins at a Silver Electrode", *Journal of Catalysis* 1975, vol. 38, pp. 294–298. No Month Available.

Chou et al., "Anodic Oxidation of Propylene on a Screen Electrode", *Chemical Engineering Science* 1980, vol. 35, pp. 1581–1590. No Month Available.

Van Der Eijk et al., "Electrochemical Epoxidation of Olefins", *Catalysis Today* 1988, vol. 3, pp. 259–266, No Month Available.

Scott et al., "Pilot Scale Electrosynthesis of Alkene Oxides by Direct and Indirect Oxidation in a Sieve Plate Electrochemical Reactor", *Chemical Engineering Science* 1992, vol. 47, pp. 2957–2962. No Month Available.

Oduoza et al., "Aspects of the Direct Electrochemical Oxidation of Propylene", *Chem. Eng. Symp. Series* 1994, No. 127, pp. 37–48. No Month Available.

Otsuka et al., "Simultaneous Epoxidation of 1–Hexene and Hydroxylation of Benzene During Electrolysis of Water", *Chemistry Letters* 1994, pp. 1861–1864. No Month Available.

Otsuka et al., "Electrocatalytic Synthesis of Propylene Oxide During Water Electrolysis", *Journal of Catalysis* 1995, vol. 157, pp. 450–460. No Month Available.

*Primary Examiner*—Kathryn Gorgos
*Assistant Examiner*—Edna Wong
*Attorney, Agent, or Firm*—James R. Franks; Irwin M. Stein

[57] ABSTRACT

Describes a method of electrochemically converting α-halohydrin, e.g., 1-chloro-2-hydroxypropane and 1,3-dichloro-2-hydroxypropane, to epoxide, e.g., propylene oxide and epichlorohydrin. An aqueous solution of α-halohydrin is charged to the catholyte compartment of an electrolytic cell, which contains a cathode, hydrogen gas is charged to the anode compartment of the cell, which contains an anode assembly comprising a hydrogen consuming gas diffusion anode fixedly held between a current collecting electrode and an anion exchange membrane. The catholyte and anode compartments of the cell are separated by the anion exchange membrane. An aqueous solution containing epoxide is removed from the catholyte compartment.

20 Claims, 3 Drawing Sheets

METHOD OF ELECTROLYTICALLY PRODUCING EPOXIDES

DESCRIPTION OF THE INVENTION

The present invention relates to a method of electrochemically producing epoxides, e.g., alkylene oxides and epihalohydrins. Particularly, the present invention relates to an electrochemical method of converting α-halohydrins to epoxides. The present invention also relates to the use of an electrolytic cell having a catholyte compartment and an anode compartment, the catholyte and anode compartments being separated by an anion exchange membrane, and wherein the anode compartment contains an anode assembly.

Commercial methods of producing epoxides, such as alkylene oxides include, for example: vapor phase oxidation of alkylene, e.g., ethylene, with molecular oxygen in the presence of a silver catalyst; catalytic reaction of alkylene, e.g., propylene, with an organic hydroperoxide, as described in U.S. Pat. No. 3,351,635; and what is known in the art as the halohydrin process. The halohydrin process, e.g., chlorohydrin process, is among the most common commercial methods of producing alkylene oxide, e.g., propylene oxide. The production of propylene oxide by the chlorohydrin process typically comprises three steps, chlorohydrination, dehydrochlorination, i.e., epoxidation, and product separation.

Chlorohydrination involves the reaction of propylene with chlorine in aqueous solution to form two isomers of propylene chlorohydrin. In the dehydrochlorination step, alkali metal hydroxide, such as sodium hydroxide, or milk of lime is added to the aqueous propylene chlorohydrin solution to form an aqueous solution of propylene oxide, organic co-products and brine, e.g., an aqueous salt solution such as aqueous sodium chloride. Separation of propylene oxide and organic co-products from the brine typically involves an evaporative or distillation process. Propylene oxide is usually separated from the organic co-products by fractional distillation. The presence of halide anion, e.g., chloride anion, in the brine requires that the distillation column(s) be fabricated from expensive corrosion resistant materials, such as titanium and stainless steel. Moreover, the waste water resulting from the distillation process is typically treated prior to disposal to remove trace amounts of organic compounds.

In the most common process of manufacturing epichlorohydrin, allyl chloride is reacted with chlorine in aqueous solution to give a mixture of 1,2-dichloro-3-propanol and 1,3-dichloro-2-propanol, sometimes referred to as an isomeric mixture of glycerol chlorohydrins. This isomeric mixture is dehydrochlorinated with an alkali and the resulting epichlorohydrin separated by steam stripping. Final purification can be accomplished by distillation. As with the above described chlorohydrin process, distillation column(s) are typically fabricated from expensive corrosion resistant materials, and the distillation waste water treated prior to disposal. In addition, contact times in all steps must be carefully controlled to minimize hydrolysis of the epichlorohydrin.

The commercial methods described above can be expensive, particularly with regard to the cost of distillation equipment, utility costs, raw material costs and the required treatment of waste streams. As a result, such methods are dedicated typically to the high volume production of epoxides and can be expensive to expand.

Methods of electrochemically producing alkylene oxide, which utilize a variety of electrochemical cell configurations and feed streams have been described in, for example, U.S. Pat. Nos.: 3,288,692; 3,427,235; 3,451,905; 3,501,388; 3,635,803; 4,560,451; 4,634,506; 4,726,887; and 5,527,436. The described electrochemical cell configurations include, single compartment, two compartment and bipolar stacked arrays. The described feed streams include, water, oxygen, alkali metal halide, e.g., potassium bromide, and olefin, e.g., propylene.

Because of the drawbacks of current commercial methods, alternative methods for producing epoxides, e.g., alkylene oxides such as propylene oxide, that are lower in cost with regard to capital investment for equipment, raw material costs, and costs for the treatment of waste streams are continually being sought. In accordance with an embodiment of the present invention, a method of converting α-halohydrins to epoxides, e.g., alkylene oxide, is provided, said method comprising:

(a) providing an electrolytic cell having a catholyte compartment containing a cathode and an anode compartment containing an anode assembly, said anode assembly comprising a hydrogen consuming gas diffusion anode fixedly held between a current collecting electrode and an anion exchange membrane; said catholyte and anode compartments being separated by said anion exchange membrane;

(b) introducing an aqueous solution comprising α-halohydrin into said catholyte compartment;

(c) introducing hydrogen gas into said anode compartment;

(d) passing direct current through said electrolytic cell; and (e) removing an aqueous solution comprising an epoxide from said catholyte compartment.

In accordance with another embodiment of the present invention, a method of converting α-halohydrins to epoxides is provided, which method comprises:

(a) providing an electrolytic cell having a catholyte compartment containing a cathode and an anode compartment containing an anode assembly, said anode assembly comprising an anion exchange membrane, a current collecting electrode, and a bed of porous catalytic particles, said catholyte and anode compartments being separated by said anion exchange membrane;

(b) introducing an aqueous solution comprising α-halohydrin into said catholyte compartment;

(c) introducing a hydrogen gas-containing aqueous solution into said anode compartment;

(d) passing direct current through said electrolytic cell; and (e) removing an aqueous solution comprising an epoxide from said catholyte compartment.

The features that characterize the present invention are pointed out with particularity in the claims, which are annexed to and form a part of this disclosure. These and other features of the invention, its operating advantages and the specific objects obtained by its use will be more fully understood from the following detailed description and the accompanying drawings in which preferred embodiments of the invention are illustrated and described.

Other than in the operating examples, or where otherwise indicated, all numbers expressing quantities of ingredients, reaction conditions, and so forth used in the specification and claims are to be understood as modified in all instances by the term "about".

BRIEF DESCRIPTION OF THE DRAWINGS

In FIGS. 1–4, like reference numerals represent the same structural parts, the same process streams and the same conduits.

DETAILED DESCRIPTION OF THE INVENTION

Figure 1:
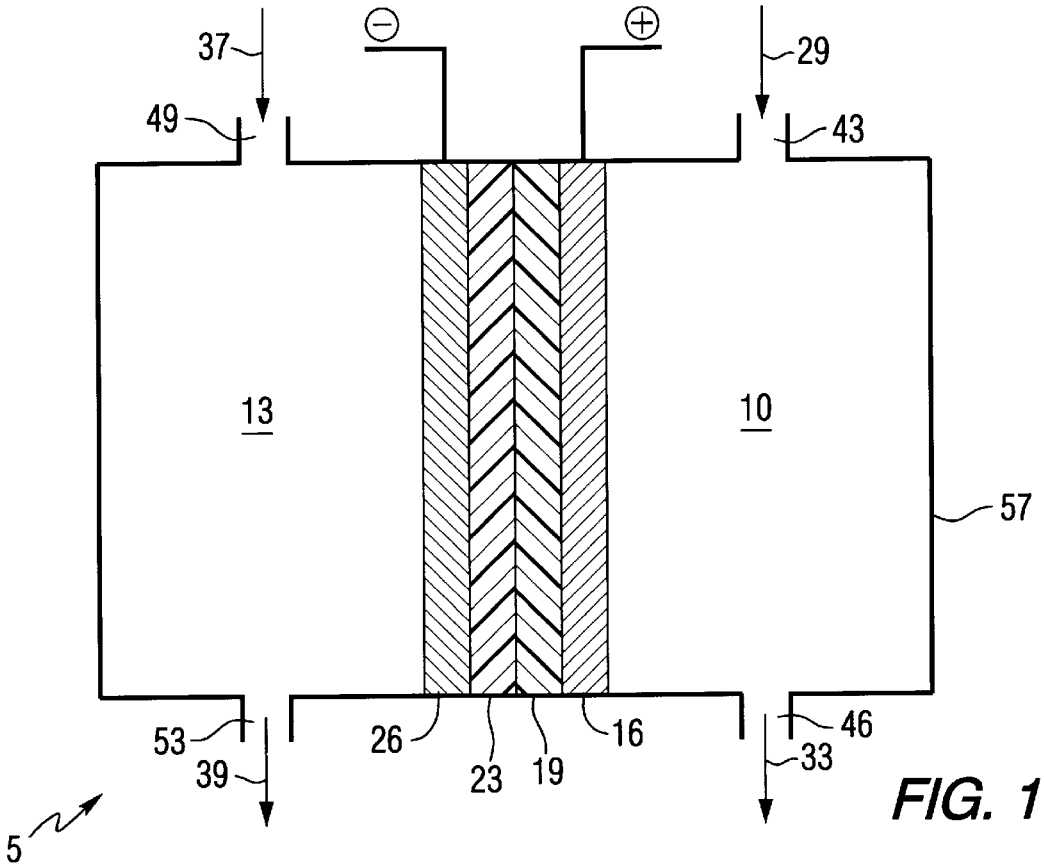
FIG. 1 is a schematic representation of an electrolytic cell useful for converting α-halohydrin to epoxide in accordance with an embodiment of the method of the present invention.

In the practice of the present invention, electrolytic cells, such as those represented in FIGS. 1 through 4, are provided for the conversion of α-halohydrin to epoxide. Referring now to FIG. 1, electrolytic cell 5 comprises a housing 57 having therein a catholyte compartment 13 and an anode compartment 10. The catholyte compartment 13 has an inlet 49 and an outlet 53, and also has therein a cathode 26. The anode compartment has an inlet 43 and an outlet 46, and also has therein an anode assembly comprised of a hydrogen consuming gas diffusion anode 19, which is fixedly held between a current collecting electrode 16 and an anion exchange membrane 23. The structural member at the junction of the catholyte and anode compartments is anion exchange membrane 23. More particularly, the anion exchange membrane forms a part of the anode assembly, which separates the catholyte and anode compartments. Cathode 26 and current collecting electrode 16 are connected to an external power source, not shown.

While cathode 26 is depicted in FIG. 1 as abutting anion exchange membrane 23, it is contemplated that cathode 26 can occupy a position within cathode compartment 13 such that it is not abutting membrane 23. If cathode 26 is not abutting anion exchange membrane 23, an additional means of supporting membrane 23 may be present within cathode compartment 13, e.g., a nonconductive screen having a mesh-like configuration, not shown, abutting membrane 23 but not abutting cathode 26.

Figure 4:
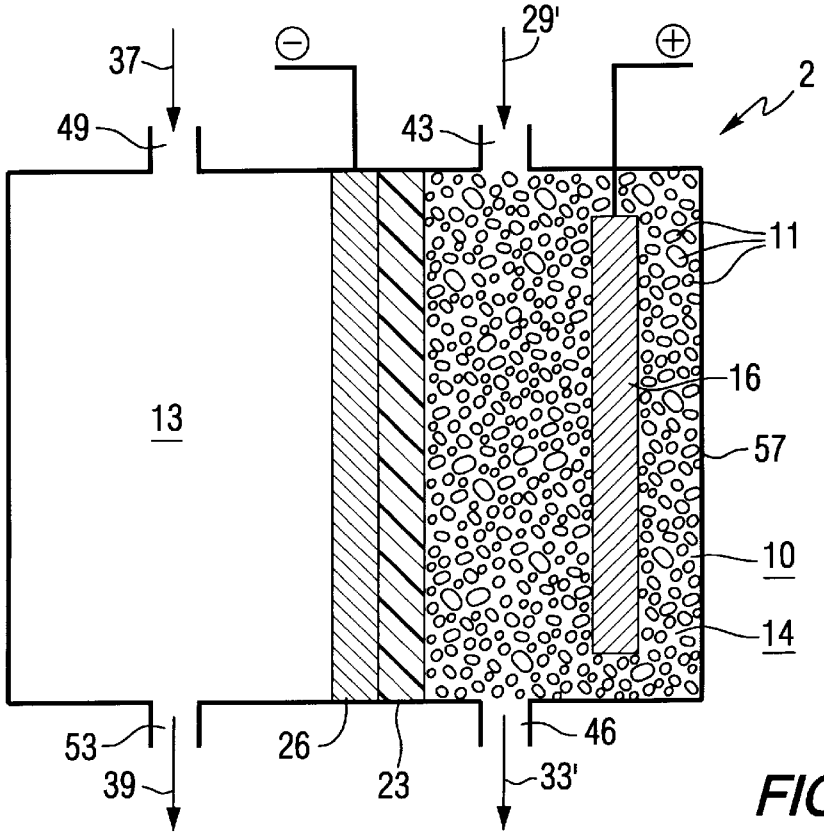
FIG. 4 is a schematic representation of an electrolytic cell useful for converting α-halohydrin to epoxide in accordance with a further embodiment of the method of the present invention wherein the anode compartment contains an anode assembly comprised in part of a bed of porous catalytic particles.

The anode assembly of electrolytic cell 2 of FIG. 4 comprises an anion exchange membrane 23, a bed 14 of porous catalytic particles 11 and a current collecting electrode 16 within bed 14. As is known to those of ordinary skill in the art, the current collecting electrode 16 is spaced from anion exchange membrane 23 to obtain an optimum level of performance, e.g., optimum current density and voltage, for the electrolytic cell. The precise position of current collecting electrode 16 relative to anion exchange membrane 23 is typically determined readily by experimentation.

Electrolytic cells 5 and 2 may be assembled by any appropriate method as long as the basic structural configuration depicted in FIGS. 1 and 4 is retained. For example, the catholyte and anode compartments may each be fabricated separately and then assembled by clamping or otherwise fastening the compartments together.

Housing 57 may be fabricated from any of the known conventional materials for electrolytic cells, or combinations of these known materials, that are preferably at least corrosion resistant to the environment to which the housing is exposed and compatible with the materials comprising the process streams present within or circulated through the catholyte and anode compartments. Examples of materials from which housing 57 may be fabricated include, but are not limited to: metal, e.g., stainless steel, titanium and nickel; plastics, e.g., poly(vinylidene fluoride), polytetrafluoroethylene, which is sold under the trademark "TEFLON" and which is commercially available from E. I. du Pont de Nemours and Company of Wilmington, Del., glass filled polytetrafluoroethylene, polypropylene, poly (vinyl chloride), chlorinated poly(vinyl chloride) and high density polyethylene. Preferred materials from which housing 57 may be fabricated include: poly(vinylidene fluoride) and stainless steel.

If housing 57 is fabricated from an electrically conductive material, such as stainless steel, then appropriately positioned nonconductive gaskets would typically also be present, as is known to those of ordinary skill in the art. For example, if the compartments of the cell are prefabricated separately from stainless steel, such gaskets would typically be placed between those portions of the prefabricated compartments that would otherwise abut each other when the electrolytic cell is assembled. Such nonconductive gaskets may be fabricated from synthetic polymeric materials, e.g., copolymers of ethylene and propylene, and fluorinated polymers.

Cathode 26 and current collecting electrode 16 each may be fabricated from any appropriate material that is at least both corrosion resistant to the environments to which they are exposed and electrically conductive. In electrolytic cell 5, it is also desirable that current collecting electrode 16 be substantially rigid so as to provide support for hydrogen consuming gas diffusion anode 19 and anion exchange membrane 23. Materials from which cathode 26 and current collecting electrode 16 may be fabricated include, but are not limited to: graphite; platinum; titanium coated with platinum; titanium coated with an oxide of ruthenium; nickel; stainless steel; specialty steels including high alloy steels containing nickel, chromium, and molybdenum, e.g., HASTELLOY® C-2000™ alloy and HASTELLOY® C-276™ alloy from Haynes International, Inc. While current collecting electrode 16 may be fabricated from stainless steel, it is preferred to use a more corrosion resistant material such as a high alloy steel, e.g., HASTELLOY® C-2000™ alloy. Cathode 26 and current collecting electrode 16 are each preferably comprised of a material selected from the group consisting of graphite, platinum, titanium coated with platinum, titanium coated with an oxide of ruthenium, nickel, stainless steel, high alloy steel, and appropriate combinations of such materials.

Preferably, both cathode 26 and current collecting electrode 16 have a perforated or mesh-like configuration. A perforated or mesh-like configuration provides for increased cathode and electrode surface area, and minimizes interference with the transport of anions across the anion exchange membrane.

Anion exchange membrane 23 used in the practice of the present invention can be prepared from any appropriate material that is permeable to and capable of transferring anions. Typically, such membranes are comprised of commercially available organic polymers, often thermoplastic polymers, containing weakly basic pendant polar groups. The membranes may comprise polymers based on fluorocarbons, polystyrene, polypropylene, polybutadiene, polyisoprene, polyisobutylene, polyethylene and hydrogenated styrene/butadiene block copolymers. For example, one such representative membrane comprises polystyrene which has dialkylamino groups that have been converted into quaternary ammonium ions covalently bonded to at least some of the benzene rings of the polystyrene backbone. It is preferable that the anion exchange membrane also be physically durable and stable towards exposure to acids, in particular hydrogen halides, e.g., hydrogen chloride.

A particular example of an anion exchange membrane used in the practice of the present invention is a copolymer of styrene and divinylbenzene which contains from 4 percent (%) to 16%, typically from 6% to 8%, by weight of divinylbenzene and also quaternary ammonium groups as anion carriers. Such membranes are available commercially under the trade designation RAIPORE® from RAI Research Corporation, and TOSFLEX® from Tosoh Corporation. Other suitable membranes include, but are not limited to: NEOSEPTA® membranes from Tokyuama Soda; SELEMION membranes from Asahi Glass; and IONAC MA 3148, MA 3236 and MA 3457 (based on a polymer of heterogeneous poly(vinyl chloride) substituted with quaternary ammonium groups) membranes from Ritter-Pfaulder Corporation. Particularly preferred anion exchange membranes are NEOSEPTA® ACM and NEOSEPTA® AHA-2 membranes, available commercially from Tokuyama Soda of Japan, which are described as being comprised of a copolymer of styrene and divinylbenzene having pendent quaternary ammonium groups.

The hydrogen consuming gas diffusion anode 19 of electrolytic cell 5 may be fabricated from any suitable material which provides an electrochemically active catalytic surface upon which hydrogen gas ($H_2$) can be converted to hydrogen cation ($H^+$), through which both hydrogen gas and halide anions may diffuse, and which is also semihydrophobic. By semihydrophobic is meant that an aqueous liquid can penetrate the anode without flooding it, i.e., without preventing the electrochemical conversion of hydrogen gas to hydrogen cation. The electrochemical activity is typically provided by a catalytic material. Examples of suitable catalytic materials include, but are not limited to, platinum, ruthenium, osmium, rhenium, rhodium, iridium, palladium, tungsten carbide, gold, titanium, zirconium, alloys of these with non-noble metals, and appropriate combinations thereof.

The hydrogen consuming gas diffusion anode 19 used in the practice of the present invention is preferably comprised of platinum, e.g., platinum supported on carbon, preferably hydrophilic carbon black, or finely powdered platinum (platinum black), which has been dispersed in a polymer matrix. Examples of useful polymer matrices include fluorinated and perfluorinated polymers. A preferred polymer in which platinum supported on hydrophilic carbon black may be dispersed is polytetrafluoroethylene. The hydrogen consuming gas diffusion anode 19 may be comprised of from 0.1 milligrams platinum per square centimeter of the hydrogen consuming gas diffusion anode ($mg/cm^2$) to 15 $mg/cm^2$, preferably from 0.5 $mg/cm^2$ to 10 $mg/cm^2$, and more preferably from 0.5 $mg/cm^2$ to 6 $mg/cm^2$. Gas diffusion anode 19 can be fixedly held between anion exchange membrane 23 and current collecting electrode 16 by any appropriate method known to those of ordinary skill in the art, provided that hydrogen consuming gas diffusion anode 19 has sufficient electrical contact with current collecting electrode 16. Such methods include, but are not limited to: maintaining a higher internal pressure within the catholyte compartment relative to the anode compartment; clamping of components 23, 19 and 16 together; providing a pair of separate biasing elements within each of the catholyte and anode compartments, e.g., a first electrically nonconductive plastic spring, not shown, in biased contact with electrode 16 and the inner wall of anode compartment 10, and a second electrically nonconductive plastic spring, not shown, in biased contact with cathode 26 and the inner wall of catholyte compartment 13; and combinations of these methods.

In one embodiment of the present invention, the hydrogen consuming gas diffusion anode 19 is hot-pressed onto one side of anion exchange membrane 23. In another embodiment of the present invention, the hydrogen consuming gas diffusion anode 19 is simply placed between the anion exchange membrane 23 and the current collecting electrode 16 prior to assembly of electrolytic cell 5. In yet another embodiment of the present invention, carbon cloth or carbon paper, not shown, is placed between hydrogen consuming gas diffusion anode 19 and current collecting electrode 16 to provide additional support to the hydrogen consuming gas diffusion anode. The carbon cloth and carbon paper are both preferably semihydrophobic, e.g., treated with TEFLON® polytetrafluoroethylene prior to use. Optionally, the carbon cloth and carbon paper may also be impregnated with a catalytic material, such as platinum.

Ensuring that electrical contact exists between anode 19 and electrode 16 of electrolytic cell 5 is important in the practice of the present invention. In one embodiment of the present invention, electrical contact is maintained between anode 19 and electrode 16 by ensuring that a positive internal pressure difference exists between the catholyte and anode compartments. By positive internal pressure difference is here meant that the internal pressure of the catholyte compartment is greater than that of the anode compartment. Values of positive internal pressure difference are determined by subtracting the internal pressure of the anode compartment from that of the catholyte compartment.

The upper limit of the positive internal pressure difference between the catholyte and anode compartments will depend on a number of factors including for example, the maximum pressure that the anion exchange membrane can endure before it bursts (burst strength). In the practice of the method of the present invention, the positive internal pressure difference between the catholyte and anode compartments will typically have a minimum value of at least 0.07 Kilograms per square centimeter ($Kg/cm^2$) (1 pound per square inch (psi)), preferably at least 0.14 $Kg/cm^2$ (2 psi), and more preferably at least 0.21 $Kg/cm^2$ (3 psi). The positive internal pressure difference between the catholyte and anode compartments will also typically have a maximum value of less than 1.40 $Kg/cm^2$ (20 psi), preferably less than 0.70 $Kg/cm^2$ (10 psi), and more preferably less than 0.49 $Kg/cm^2$ (7 psi). In the practice of the method of the present invention, the positive internal pressure difference between the catholyte and anode compartments may range between any combination of these minimum and maximum values, inclusive of the recited values.

The catalytic particles of the bed 14 of porous catalytic particles 11 of electrolytic cell 2 of FIG. 4 may be fabricated from any suitable material that provides an electrochemically active, electrically conductive surface upon which hydrogen gas ($H_2$) may be converted to hydrogen cation ($H^+$), and which is also semihydrophobic. By semihydrophobic is meant that an aqueous liquid can penetrate the catalytic particles without flooding them, i.e., without preventing the electrochemical conversion of hydrogen gas to hydrogen cation. It is preferred that the catalytic particle itself be a coated particle having a substrate which is at least partially covered, and preferably substantially covered, with an electrochemically active and electrically conductive coating.

The substrate may be electrically conductive or electrically nonconductive, and chemically inert or chemically active. Substrates which are electrically conductive, chemically inert, and hold their shape are preferred. The substrate may be of any shape or combination of shapes, e.g., irregularly and/or spherically shaped, and of a size smaller than 0.3 mm to as large as or larger than 25 mm. Spherically shaped substrates having a size of from 0.7 mm to 4 mm are generally preferred. The substrate may be a material selected from the group consisting of steel, iron, graphite, nickel, platinum, copper and silver. In a particularly preferred embodiment of the present invention, the substrate is graphite.

The coating on the substrate is an admixture of a binder and an electrochemically active, electrically conductive catalyst, and may be of any convenient thickness, e.g., from 5 to 75 microns. Thicknesses of 25 microns are particularly preferred. The coating may be either porous or nonporous, preferably porous. The binder is preferably a hydrophobic material prepared from a synthetic polymer, examples of which include, but are not limited to: polytetrafluoroethylene; polychlorotrifluoroethylene; polytrifluoroethylene; polvinylfluoride; poly(vinylidenefluoride); and copolymers including interpolymers and terpolymers prepared from monomers including, tetrafluoroethylene, trifluoroethylene, chlorotrifluoroethylene, vinylidine fluoride and vinyl fluoride monomers. Polytetrafluoroethylene is particularly preferred.

The coating on particles 11 also contains an electrochemically active, electrically conductive catalyst material. Examples of suitable catalyst materials include, but are not limited to, platinum, ruthenium, osmium, rhenium, rhodium, iridium, palladium, tungsten carbide, gold, titanium, zirconium, alloys of these with non-noble metals, and combinations thereof. The catalyst material may also be supported on carbon, preferably carbon black, and more preferably hydrophilic carbon black. A particularly preferred catalyst material is platinum supported on hydrophilic carbon black.

Catalytic particles 11 preferably comprise graphite substantially coated with an admixture of polytetrafluoroethylene and platinum supported on carbon black, and in particular, hydrophilic carbon black. Catalytic particles that may be used in the present invention are described also in U.S. Pat. No. 4,481,303, the disclosure of which is incorporated herein by reference in its entirety.

The present invention relates to a method of electrochemically preparing epoxide from α-halohydrin. As used herein and in the claims, by the term "α-halohydrin" is meant a hydroxy or polyhydroxy functional organic species having at least one halo group covalently bonded to an $sp^3$ hybridized carbon atom, which is in a position alpha to at least one $sp^3$ hybridized carbon atom having a hydroxy group covalently bonded thereto, e.g., 1-chloro-2-hydroxypropane and 1,3-dichloro-2-hydroxypropane. Further, as used herein and in the claims, by the term "epoxide" is meant an organic compound containing one or more three membered cyclic ether groups, e.g., alkylene oxides and epihalohydrins.

The halo of the α-halohydrin is selected from the group consisting of chloro, bromo and iodo. The backbone of the α-halohydrin may be a straight or branched chain alkane having from 2 to 20 carbon atoms, preferably from 2 to 12 carbon atoms, and more preferably from 2 to 6 carbon atoms, e.g., ethane, propane, butane, isobutane, pentane, isopentane, hexane, octane, dodecane and octadecane, or a cyclic alkane having from 5 to 12 carbon atoms, e.g., cyclopentane, cyclohexane, cyclooctane and cyclododecane. Further, the α-halohydrin may have: aryl substituents, e.g., phenyl, cumenyl, mesityl, tolyl and xylyl substituents; ethylenic unsaturated substituents; and halogen, oxygen and sulfur-containing substituents, e.g., hydroxyl, thiol, carboxylic acid, ester, ether and thioether substituents.

The α-halohydrins useful in the present invention may be prepared by art-recognized methods, exemplary of which is the reaction of a hypohalous acid, e.g., hypochlorous acid, hypobromous acid or hypoiodous acid, with an olefin, e.g., ethene, propene, 1-butene, 2-butene, 1,3-butadiene, 9,10-octadecanoic acid, esters of 9,10-octadecanoic acid, 9,12-octadecadienoic acid, esters of 9,12-octadecadienoic acid, cyclopentene, vinylcyclopentane, cyclohexene, 1,4-cyclohexadiene, vinylcyclohexane, divinylcyclohexane, styrene and divinylbenzene. The reaction of hypohalous acid with olefin will also typically result in the co-product formation of aqueous hydrogen halide, e.g., hydrogen chloride, hydrogen bromide or hydrogen iodide. The aqueous hydrogen halide co-product will generally be present in an amount of less than 3% by weight, for example, less than 2% by weight, based on the total weight of the aqueous solution comprising α-halohydrin.

Representative α-halohydrins useful in the present invention include, but are not limited to, 2-chloro-1-hydroxyethane, 2-bromo-1-hydroxyethane, 1-chloro-2-hydroxypropane, 1-iodo-2-hydroxypropane, 2-chloro-1-hydroxypropane, 1,3-dichloro-2-hydroxypropane, 2,3-dichloro-1-hydroxypropane, 1,3-dibromo-2-hydroxypropane, 2,3-dibromo-1-hydroxypropane, 3-chloro-1,2-dihydroxypropane, α-chlorohydroxybutane, e.g., 1-chloro-2-hydroxybutane, 1,4-dichloro-2,3-dihydroxybutane, 1-chloro-2-hydroxycyclopentane, (α-chloro-hydroxyethyl)cyclopentane, 1-chloro-2-hydroxycyclohexane, (α-chloro-hydroxyethyl)cyclohexane, bis(α-chloro-hydroxyethyl)cyclohexane, e.g., 1,2-, 1,3- and 1,4-bis(1-chloro-2-hydroxyethyl)cyclohexane, (α-chloro-hydroxyethyl)benzene and bis(α-chloro-hydroxyethyl) benzene, e.g., 1,2-, 1,3- and 1,4-bis(1-chloro-2-hydroxyethyl)benzene. In a preferred embodiment of the present invention, the α-halohydrin is selected from the group consisting of 1-chloro-2-hydroxypropane, 2-chloro-1-hydroxypropane, 1,3-dichloro-2-hydroxypropane, 1,3-dibromo-2-hydroxypropane and mixtures thereof.

When the α-halohydrin contains more than three carbon atoms, its solubility in the aqueous solution circulated through catholyte compartment 13 will be reduced and the rate at which it is converted to an epoxide will also be reduced. Accordingly, to improve the solubility of the α-halohydrin, a co-solvent may also be present in the circulated aqueous solution. Examples of cosolvents suitable for use in aqueous solutions include, but are not limited to: hydroxy functional ethers of ethylene glycol, e.g., butyl 2-hydroxyethyl ether and hexyl 2-hydroxyethyl ether; and hydroxy functional ethers of 1,2-dihydroxy propane, e.g., methyl 2-hydroxypropyl ether and phenyl 2-hydroxypropyl ether. If used, cosolvents are generally present in amounts of less than 10 percent by weight, e.g., less than 5 percent by weight, based on total weight of the aqueous solution circulated through catholyte compartment 13.

Representative epoxides that may be prepared in accordance with the method of the present invention include, but are not limited to, ethylene oxide, propylene oxide, 1-chloro-2,3-epoxypropane (epichlorohydrin), 1-bromo-2,3-epoxypropane (epibromohydrin), 1-hydroxy-2,3-epoxypropane, 1,2-epoxybutane, 2,3-epoxybutane, 1,2,3,4-diepoxybutane, 1,2-epoxypentane, 1,2-epoxyhexane, 1,2-epoxyoctane, 1,2,7,8-diepoxyoctane, 1,2-epoxydecane, 1,2-epoxydodecane, 6-oxabicyclo[3.1.0]hexane, 7-oxabicyclo[4.1.0]heptane, 3-epoxyethyl-7-oxabicyclo[4.1.0]heptane, 7-oxabicyclo[4.1.0]heptan-2-one, 3,4-epoxycyclohexylmethyl 3,4-epoxycyclohexanecarboxylate, exo-2,3-epoxynorborane, 9-xabicyclo[6.1.0]nonane, 1,2,5,6-diepoxycyclooctane, 1,2-poxycyclododecane, 1,2-epoxyethylbenzene, 2,3-(epoxypropyl)benzene, 1,2-epoxy-3-phenoxypropane and 2,3-poxypropyl 4-methoxyphenyl ether.

The operation of electrolytic cells 5 and 2 of FIGS. 1 through 4 will now be described as it relates to preferred embodiments of the process of the present invention. An aqueous solution comprising α-halohydrin is circulated through catholyte compartment 13 by forwarding the solution from a source of α-halohydrin, e.g., temperature controlled reservoir 60 shown in FIGS. 2 and 3, through a suitable conduit (shown by line 37) into catholyte compartment 13 through inlet 49; withdrawing a process stream comprising epoxide and α-halohydrin from catholyte compartment 13 through outlet 53; and forwarding that process stream by a suitable conduit (shown by line 39) to the source of α-halohydrin, e.g., reservoir 60.

Figure 2:
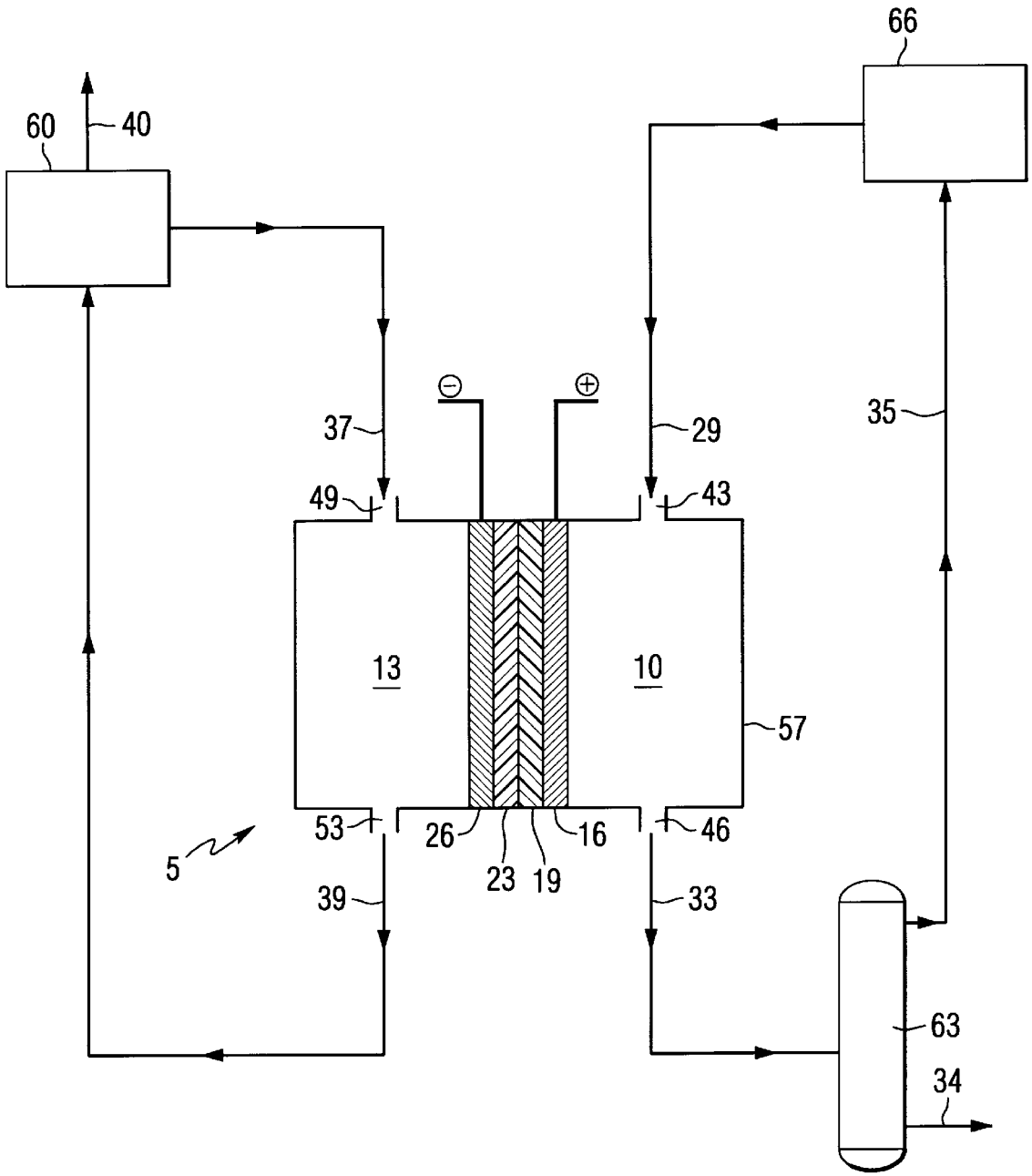
FIG. 2 is a schematic of the electrolytic cell depicted in FIG. 1 further comprising closed loops around the catholyte and anode compartments for the process streams charged to and withdrawn from such compartments, and means for removing and recovering concentrated, substantially dry hydrogen halide from the anode compartment.
Figure 3:
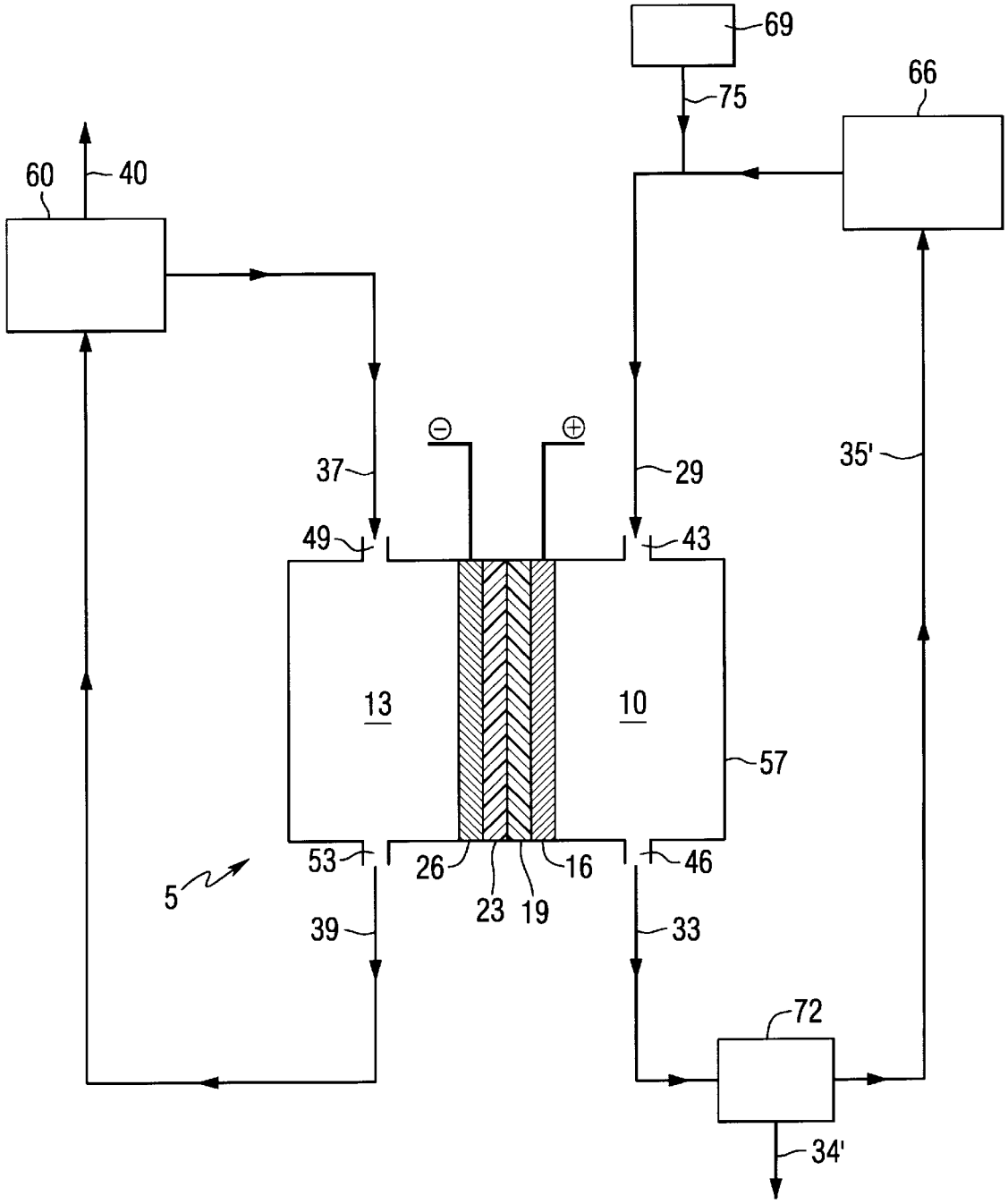
FIG. 3 is a schematic of the electrolytic cell depicted in FIG. 1 further comprising closed loops around the catholyte and anode compartments for the process streams charged to and withdrawn from such compartments, and means for introducing steam into, and recovering concentrated aqueous hydrogen halide from, the anode compartment.

Similarly and simultaneously, in connection with electrolytic cell 5, hydrogen gas is circulated through anode compartment 10 by forwarding hydrogen gas from a source of hydrogen, e.g., reservoir 66 shown in FIGS. 2 and 3, through a suitable conduit or transfer line (shown by line 29); introducing such hydrogen gas into anode compartment 10 through inlet 43; withdrawing hydrogen gas from anode compartment 10 through outlet 46; and forwarding withdrawn hydrogen gas by a suitable conduit or transfer line (shown by line 33) to the source of hydrogen, e.g., reservoir 66.

In connection with electrolytic cell 2 of FIG. 4, a hydrogen gas-containing aqueous solution is circulated through anode compartment 10 by forwarding said hydrogen gas-containing solution, from a reservoir, not shown, to anode compartment 10 through a suitable conduit (shown by line 29'); introducing such hydrogen gas-containing solution into anode compartment 10 through inlet 43; withdrawing hydrogen gas-containing solution from anode compartment 10 through outlet 46; and forwarding withdrawn hydrogen gas-containing solution through a conduit or transfer line (shown by line 33') to the source of source of hydrogen gas-containing solution, e.g., a reservoir not shown. The hydrogen gas-containing aqueous solution is preferably comprised of water and hydrogen gas. Other gas(es) may be present with the hydrogen gas circulated through the anode compartment 10., e.g., nitrogen, as long as such other gas(es) does not adversely affect the operation of the electrolytic cell. In particular, it is preferred that the hydrogen gas-containing stream be substantially free of carbon monoxide (CO) as carbon monoxide can poison or otherwise degrade the gas diffusion hydrogen gas anode 19 of eletrolytic cell 5, and the porous catalytic particles 11 of electrolytic cell 2 of FIG. 4.

The temperature at which the aqueous solution of α-halohydrin is maintained depends on, for example, its boiling point and the operating temperature limits of the anion exchange membrane. In the practice of the present invention, the aqueous solution of α-halohydrin is typically maintained at a minimum temperature of at least 15° C., preferably at least 20° C., and more preferably at least 25° C. The aqueous solution of α-halohydrin is also typically maintained at a maximum temperature of less than 40° C., preferably less than 35° C., and more preferably less than 30° C. The temperature at which the aqueous solution of α-halohydrin is maintained may range between any combination of these minimum and maximum temperature values, inclusive of the recited values.

The aqueous solution of α-halohydrin typically contains α-halohydrin present in an amount of at least 1% by weight, preferably at least 2% by weight, and more preferably at least 3% by weight, based on the total weight of the aqueous solution of α-halohydrin. The aqueous solution of α-halohydrin also typically contains α-halohydrin present in an amount of not more than 30% by weight, preferably not more than 15% by weight, and more preferably not more than 10% by weight, based on the total weight of the aqueous solution of α-halohydrin. The amount of α-halohydrin present in the aqueous solution of α-halohydrin may range between any combination of these amounts, inclusive of the recited amounts.

The aqueous solution comprising α-halohydrin may optionally contain an electrical conductivity enhancing additive, e.g., a salt. Examples of suitable salts include, but are not limited to, an alkali metal halide, e.g., lithium chloride, sodium chloride, sodium bromide, sodium iodide, potassium chloride, potassium bromide and potassium iodide; and an alkaline earth metal halide, e.g., magnesium chloride and calcium chloride. If used, the salt is typically present in the aqueous solution comprising α-halohydrin in an amount of at least 0.05% by weight, preferably at least 0.1% by weight, and more preferably at least 0.5% by weight, based on the total weight of the aqueous solution comprising α-halohydrin. The salt may also be present in an amount of not more than 10% by weight, preferably not more than 5% by weight, and more preferably not more than 3% by weight, based on the total weight of the aqueous solution comprising α-halohydrin. The amount of salt present in the aqueous solution comprising α-halohydrin may range between any combination of these amounts, inclusive of the recited amounts.

In accordance with the method of the present invention, direct current is passed through the electrolytic cell while the aforedescribed process streams are circulated through the catholyte and anode compartments. Electrolytic cells 5 and 2 may be operated at a current density of at least 0.05 Kiloamperes per square meter of electrode surface available for electrochemical reaction (Kamps/$m^2$), preferably at least 0.1 Kamps/$m^2$, and more preferably at least 0.2 Kamps/$m^2$. The current density also may be not more than 10 Kamps/$m^2$, preferably not more than 7 Kamps/$m^2$, and more preferably not more than 6 Kamps/$m^2$. In the practice of the method of the present invention, the current density may range between any combination of these values, inclusive of the recited values. The surface area of the electrode being here calculated from its perimeter dimensions alone.

While not meaning to be bound by any theory, it is believed from the evidence at hand that the current passing through the electrolytic cell results in chemical and electrochemical reactions that are hereinafter described. The electrochemical and chemical reactions believed to occur within the catholyte compartment 13 may be represented by the following General Scheme I:

General Scheme I

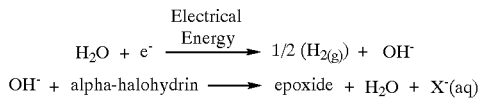

The halide anion $X^-$ is selectively transported across anion exchange membrane 23 and passes into hydrogen consuming gas diffusion anode 19. The electrons consumed, as shown in General Scheme I, are provided by cathode 26.

Within anode compartment 10, the following electrochemical and chemical reactions are believed to occur, as represented by General Scheme II:

General Scheme II

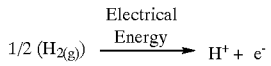

Within and/or on the surface of the hydrogen consuming gas diffusion anode 19 of electrolytic cell 5, the halide anion $X^-$ together with the hydrogen cation $H^+$ forms gaseous hydrogen halide. The electrons produced, as shown in General Scheme II, are transferred by electrical contact from the hydrogen consuming gas diffusion anode 19 to the current collecting electrode 16.

In the case of electrolytic cell 2, within and/or on the surface of catalytic particles 11, the halide anion together with the hydrogen cation forms hydrogen halide which dissolves in the aqueous medium to form aqueous hydrogen halide. The electrons produced are likewise transferred to the current collecting electrode 16 directly from the bed of porous catalytic particles 11 and/or through the aqueous solution circulating through the anode compartment.

During the operation of either of electrolytic cells 5 or 2, the concentration of epoxide within the circulating aqueous solution of α-halohydrin increases with each pass through catholyte compartment 13. The process stream withdrawn from catholyte compartment 13 will contain a higher amount of epoxide than the process stream entering catholyte compartment 13. Correspondingly, the process stream withdrawn from anode compartment 10 will contain a higher amount of hydrogen halide than the process stream entering anode compartment 10.

When the concentration of epoxide in the process stream circulating through catholyte compartment 13 reaches a desired level, the epoxide is recovered from that stream. Of the total molar equivalents of α-halohydrin initially present in the aqueous solution of α-halohydrin circulated through catholyte compartment 13, at least 50%, preferably at least 80%, more preferably at least 99%, and particularly preferably 100% of these equivalents are converted to epoxide in accordance with the practice of the method of the present invention.

Epoxide produced according to the present invention may be recovered, i.e., isolated, from the aqueous solution removed from catholyte compartment 13 by methods that are known to those of ordinary skill in the art. Such art-recognized recovery methods include, but are not limited to, steam distillation and vacuum distillation.

While a batch process has been described, a continuous process for converting the α-halohydrin to epoxide is contemplated. For example, a side stream of the circulating aqueous stream of α-halohydrin can be removed to make the process a continuous or semi-continuous process.

In accordance with the embodiment of the present invention described with reference to FIG. 2, hydrogen halide gas is recovered as concentrated substantially dry hydrogen halide from the hydrogen gas stream removed from anode compartment 10. By concentrated substantially dry hydrogen halide is meant hydrogen halide having less than 2% by weight of water, preferably less than 1% by weight of water, and more preferably less than 0.5% by weight of water, based on the total weight of the concentrated substantially dry hydrogen halide collected. The concentrated substantially dry hydrogen halide, e.g., hydrogen chloride, can be recovered by forwarding the hydrogen gas process stream containing hydrogen halide removed from anode compartment 10 (or a portion thereof) to condenser 63. In condenser 63, the hydrogen halide gas condenses as concentrated substantially dry hydrogen halide; is separated from the circulating hydrogen gas; and withdrawn from the condenser by means of conduit 34. The hydrogen gas stream removed from condenser 63 through conduit 35 is substantially free of hydrogen halide and is recycled to reservoir 66. By substantially free of hydrogen halide is meant that the hydrogen gas stream in conduit 35 contains less than 0.5% by weight of hydrogen halide, based on the total weight of the hydrogen gas stream 35.

In addition, hydrogen gas generated in catholyte compartment 13 can be removed from reservoir 60 through conduit 40. The hydrogen gas removed from conduit 40 may be transferred to hydrogen gas reservoir 66 by way of a conduit not shown.

In accordance with the embodiment of the present invention described with reference to FIG. 3, steam from steam source 69 is introduced into anode compartment 10 by adding it to conduit 29 by means of conduit 75, which connects the steam source with conduit 29. The steam serves to enhance the removal of hydrogen halide, e.g., hydrogen chloride, from the surface of the hydrogen consuming gas diffusion anode 19. The hydrogen halide is dissolved in the steam and is withdrawn from anode compartment 10 as concentrated aqueous hydrogen halide. By concentrated aqueous hydrogen halide is meant an aqueous solution of hydrogen halide having present therein from 25% to 35% by weight of hydrogen halide, preferably from 28% to 35% by weight of hydrogen halide, and more preferably from 30% to 35% by weight of hydrogen halide, based on the total weight of the concentrated aqueous hydrogen halide collected. The concentrated aqueous hydrogen halide is forwarded to hydrogen halide collection unit 72 through conduit 33, and removed therefrom through conduit 34'. The hydrogen gas removed from concentrated aqueous hydrogen halide collection unit 72 and forwarded to reservoir 66 through conduit 35' is substantially free of hydrogen halide. By substantially free of hydrogen halide is meant that the hydrogen gas in conduit 35' contains less than 0.5% by weight of hydrogen halide, based on the total weight of the hydrogen gas stream passing through conduit 35'.

While FIGS. 1–4 depict singular representations of electrolytic cells, it should be understood that the scope of the present invention is also inclusive of the utilization of a plurality of such cells. The present invention may be practiced using a plurality of cells, e.g., electrolytic cells 5 or 2, either in series or parallel. In one embodiment, a plurality of cells, not shown, e.g., electrolytic cell 5, are utilized in series, wherein outlets 53 and 46 of each preceding cell are in respective communication with inlets 49 and 43 of each succeeding cell by means of additional conduits, not shown.

In another embodiment of the present invention, a plurality of cells, not shown, e.g., electrolytic cell 5, are utilized in parallel, wherein inlet 49 and outlet 53 of catholyte compartment 13 of each cell are in common closed loop communication with reservoir 60 by means of conduits and manifolds, not shown. Accordingly, inlet 43 and outlet 46 of anode compartment 10 of each cell are in common closed loop communication with reservoir 66 by means of conduits and manifolds, not shown.

The present invention has been described with reference to specific details of particular embodiments thereof. It is not intended that such details be regarded as limitations upon the scope of the invention except insofar as and to the extent that they are included in the accompanying claims.

We claim:

1. A method of converting α-halohydrin to epoxide comprising:

(a) providing an electrolytic cell having a catholyte compartment containing a cathode; and an anode compartment containing an anode assembly, said anode assembly comprising a hydrogen consuming gas diffusion anode fixedly held between a current collecting electrode and an anion exchange membrane; said catholyte and anode compartments being separated by said anion exchange membrane;

(b) introducing an aqueous solution comprising α-halohydrin into said catholyte compartment;

(c) introducing hydrogen gas into said anode compartment;

(d) passing direct current through said electrolytic cell; and (e) removing an aqueous solution comprising epoxide from said catholyte compartment.

2. The method of claim 1 wherein said α-halohydrin is selected from the group consisting of 2-chloro-1-hydroxyethane, 1-chloro-2-hydroxypropane, 2-chloro-1-hydroxypropane, 1,3-dichloro-2-hydroxypropane, 1,3-dibromo-2-hydroxypropane, 1-chloro-2-hydroxycyclopentane, 1-chloro-2-hydroxycyclohexane, (α-chloro-hydroxyethyl)cyclohexane, bis(α-chloro-hydroxyethyl)cyclohexane, (α-chloro-hydroxyethyl) benzene, bis(α-chloro-hydroxyethyl)benzene and mixtures thereof.

3. The method of claim 2 wherein said α-halohydrin is selected from the group consisting of 1-chloro-2-hydroxypropane, 2-chloro-1-hydroxypropane, 1,3-dichloro-2-hydroxypropane, 1,3-dibromo-2-hydroxypropane and mixtures thereof.

4. The method of claim 1 further comprising the step of removing a hydrogen halide-containing hydrogen gas stream from said anode compartment and recovering substantially dry hydrogen halide from said gas stream.

5. The method of claim 1 further comprising introducing steam into said anode compartment.

6. The method of claim 5 further comprising the step of removing an aqueous hydrogen halide-containing hydrogen gas stream from said anode compartment and recovering aqueous hydrogen halide from said gas stream.

7. The method of claim 1 wherein a positive internal pressure difference of from 0.07 $Kg/cm^2$ to 1.40 $Kg/cm^2$ exists between said catholyte and anode compartments.

8. The method of claim 1 wherein said hydrogen consuming gas diffusion anode comprises platinum supported on carbon black dispersed in polytetrafluoroethylene.

9. The method of claim 8 wherein said anion exchange membrane comprises a copolymer of styrene and divinylbenzene having pendent quaternary ammonium salt groups.

10. The method of claim 9 wherein said cathode and said current collecting electrode each comprises a material selected from the group consisting of graphite, platinum, titanium coated with platinum, titanium coated with an oxide of ruthenium, stainless steel, high alloy steel and appropriate combinations of such materials.

11. The method of claim 10 wherein said α-halohydrin is selected from the group consisting of 1-chloro-2-hydroxypropane, 2-chloro-1-hydroxypropane, 1,3-dichloro-2-hydroxypropane, 1,3-dibromo-2-hydroxypropane and mixtures thereof.

12. The method of claim 11 further comprising introducing steam into said anode compartment.

13. The method of claim 12 further comprising the step of removing an aqueous hydrogen halide-containing hydrogen gas stream from said anode compartment and recovering aqueous hydrogen halide from said gas stream.

14. The method of claim 13 wherein a positive internal pressure difference of from 0.07 $Kg/cm^2$ to 1.40 $Kg/cm^2$ exists between said catholyte and anode compartments.

15. A method of converting α-halohydrin to epoxide comprising:

(a) providing an electrolytic cell having a catholyte compartment containing a cathode; and an anode compartment containing an anode assembly, said anode assembly comprising an anion exchange membrane, a current collecting electrode, and a bed of porous catalytic particles; said catholyte and anode compartments being separated by said anion exchange membrane;

(b) introducing an aqueous solution comprising α-halohydrin into said catholyte compartment;

(c) introducing a hydrogen gas-containing aqueous solution into said anode compartment;

(d) passing direct current through said electrolytic cell; and (e) removing an aqueous solution comprising epoxide from said catholyte compartment.

16. The method of claim 15 wherein said α-halohydrin is selected from the group consisting of 2-chloro-1-hydroxyethane, 1-chloro-2-hydroxypropane, 2-chloro-1-hydroxypropane, 1,3-dichloro-2-hydroxypropane, 1,3-dibromo-2-hydroxypropane, 1-chloro-2-hydroxycyclopentane, 1-chloro-2-hydroxycyclohexane, (α-chloro-hydroxyethyl)cyclohexane, bis(α-chloro-hydroxyethyl)cyclohexane, (α-chloro-hydroxyethyl) benzene, bis(α-chloro-hydroxyethyl)benzene and mixtures thereof.

17. The method of claim 15 wherein the porous catalytic particles are comprised of a substrate substantially coated with an admixture of a hydrophobic binder and a catalyst material selected from the group consisting of platinum, ruthenium, osmium, rhenium, rhodium, iridium, palladium, tungsten carbide, gold, titanium, zirconium and combinations of said catalyst materials, said substrate being selected from the group consisting of steel, iron, graphite, nickel, platinum, copper and silver.

18. The method of claim 17 wherein said substrate is graphite, said hydrophobic binder is polytetrafluoroethylene, and said catalyst material is platinum supported on carbon black.

19. The method of claim 15 wherein said anion exchange membrane comprises a copolymer of styrene and divinylbenzene having pendent quaternary ammonium salt groups.

20. The method of claim 15 wherein said cathode and said current collecting electrode each comprises of a material selected from the group consisting of graphite, platinum, titanium coated with platinum, titanium coated with an oxide of ruthenium, nickel, stainless steel, high alloy steel, and appropriate combinations of such materials.

* * * * *